United States Patent [19]

Kusuki et al.

[11] Patent Number: 4,654,910

[45] Date of Patent: Apr. 7, 1987

[54] SPUN YARN PILING AND CLEANING METHOD

[75] Inventors: Yoshihiro Kusuki; Masao Kikuchi; Yoshio Takeuchi, all of Ichihara, Japan

[73] Assignee: UBE Industries, Ltd., Yamaguchi, Japan

[21] Appl. No.: 780,060

[22] Filed: Sep. 25, 1985

[30] Foreign Application Priority Data

Sep. 28, 1984 [JP] Japan ..... 59-201460
Jun. 7, 1985 [JP] Japan ..... 60-122824

[51] Int. Cl.[4] ..... D06B 3/04

[52] U.S. Cl. ..... 8/151.2; 68/13 R; 68/177; 68/205 R

[58] Field of Search ..... 8/151, 151.2, 152; 68/177, 178

[56] References Cited

U.S. PATENT DOCUMENTS 1,396,792 11/1921 Taylor ..... 8/152
1,418,136 5/1922 Dreaper ..... 8/151.2 X
1,766,716 6/1930 McConnell ..... 8/151.2 X
1,825,478 9/1931 Rowley et al. ..... 68/178 X
2,149,708 3/1939 Recklinghausen et al. ..... 8/151.2
3,605,146 9/1971 Amengual ..... 8/152 X
3,767,360 10/1973 Singh ..... 8/152 X

FOREIGN PATENT DOCUMENTS 209457 3/1907 Fed. Rep. of Germany ..... 68/178
223686 2/1959 United Kingdom ..... 68/178

*Primary Examiner*—Harvey C. Hornsby
*Assistant Examiner*—Frankie L. Stinson
*Attorney, Agent, or Firm*—Townsend & Townsend

[57] ABSTRACT

A method for piling and cleaning a spun yarn in a wet spinning in which a yarn is withdrawn at a predetermined velocity and is dropped by its own weight into a rotating cylindrical container with the bottom formed with drain holes while simultaneously traversing the yarn in the radial direction of the cylindrical container so that the yarn is piled at the bottom of the cylindrical container in the form of a ring; and a cleaning liquid is sprayed against the yarn which is being piled, thereby cleaning the yarn.

3 Claims, 9 Drawing Figures

SPUN YARN PILING AND CLEANING METHOD

BACKGROUND OF THE INVENTION

The present invention relates to a method for piling and cleaning a spun yarn and more particularly a wet spun yarn.

In a wet spinning process which is one of the spinning processes for various kinds of chemical fibers such as polyacryalnitrile, acetate cellulose, polyamid and the like, a polymer solution, which is a yarn mother solution, is sprayed through extremely small holes of nozzles into a solidification bath containing water or containing a mixture of water and an organic solvent. Thereafter, the spun yarn is separated from the solution and solidified and elongated.

The yarn thus spun is transported straight at a predetermined velocity by means of rollers and is made to pass through an elongated shower room to be cleaned. Next the cleaned yarn is transported to the next drying step.

When the above-described prior art yarn cleaning process is employed, the space for a cleaning installation is very large and moreover the cleaning time is longer. Furthermore, high tension is exerted to the yarn so that the yarn is broken off.

SUMMARY OF THE INVENTION

In view of the above, a main object of the present invention is to provide a method for piling and cleaning the spun yarn which can reduce a space required for installation of a cleaning device and the cleaning time and can provide high quality yarns which are not broken off and are free from any external damage.

According to the present invention, a spun yarn is withdrawn at a predetermined velocity and is dropped by its own weight into a cylindrical container which is rotating and which has the bottom formed with openings while simultaneously traversing the yarn in the radial direction of the cylindrical container so that the yarn is piled at the bottom of the cylindrical container in the form of a ring; and a cleaning liquid is continuously sprayed against the yarn which is being piled, thereby cleaning the yarn.

According to another aspect of the present invention, after the yarn of a predetermined length has been piled and cleaned in the manner described above, beads are filled in the cylindrical container such a way that the yarn piled in the cylindrical container is covered with the beads while leaving the trailing end of the yarn over the top surface of the layer of beads. Thereafter the cylindrical container is rotated in the direction opposite to the direction in which the cylindrical container was rotated when the yarn was being piled and cleaned so that the yarn is withdrawn from its trailing end out of the cylindrical container to the exterior.

The above and other objects, effects, features and advantages of the present invention will become more apparent from the following description of preferred embodiments thereof taken in conjunction with the accompanying drawings.

DETAILED DESCRIPTION OF THE PREFERRED EMBODIMENT

The present invention will be described in detail with reference to the accompanying drawings.

Figure 1:
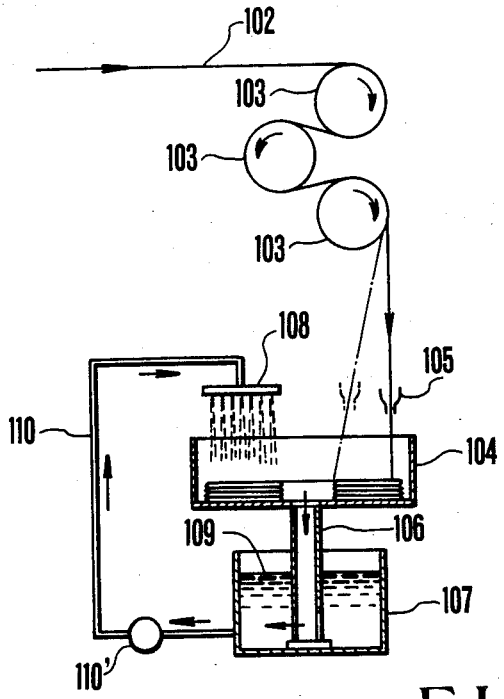
FIG. 1 is a view used to explain the piling and cleaning of a yarn in accordance with the present invention.
Figure 2A:
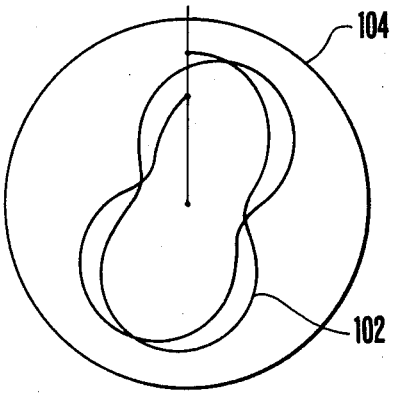
FIGS. 2A and 2B are sequential views used to explain a pattern of pile yarn.
Figure 2B:
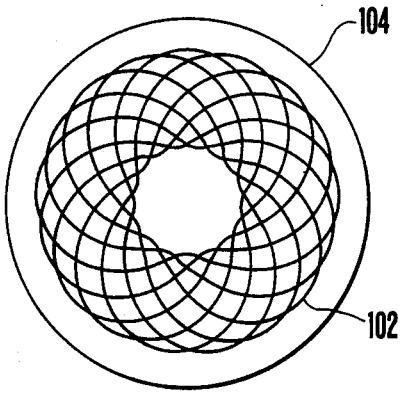
Figure 3:
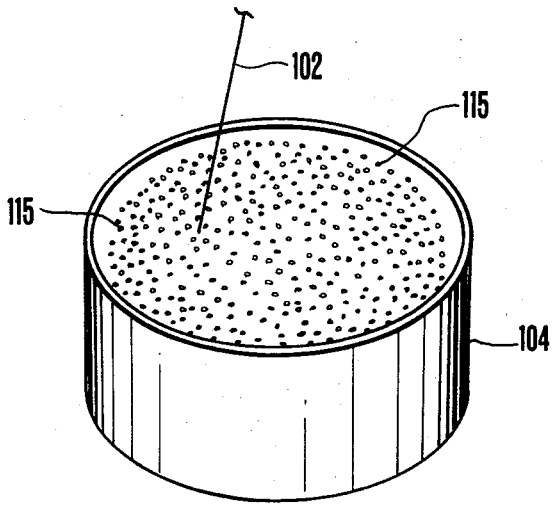
FIG. 3 is a view used to explain the filling of beads after the yarn has been piled and cleaned in accordance with the present invention.

Referring first to FIG. 1 showing the piling and cleaning of spun yarn, a yarn 102 which is discharged through a nozzle, separated from a liquid and solidified is transported horizontally toward rollers 103 which are rotating in the direction indicated by the arrows, respectively. The yarn 102 is made into contact with these rollers 103 and drops from the last roller 103 by its own weight at a relatively low velocity of 5–30 m/min into a cylindrical container 104 with a bottom, which is generally called "a can". The upper end of a can supporting pipe 106 which is cylindrical and hollow is detachably connected to the center of the bottom of the can 104 while the lower end thereof is connected to the drive shaft of a motor, not shown. Upon rotation of the can supporting pipe 106, the can 104 is also rotated. A traverse guide 105 which has a hole through which is extended the yarn 102 is adapted to reciprocate in the radial directions of the can 104 (to the right and left in FIG. 1). That is, the traverse guide 105 is caused to reciprocate between the position indicated by the solid lines and the position indicated by the broken lines by means of a traverse device (not shown). The yarn 102 which is dropped into the can 104 is piled in the form of a ring at the bottom thereof when the reciprocation period and the amplitude of the traverse guide 105 are suitably selected. FIG. 2A shows the pattern of the yarn 102 piled at the bottom of the can 104 when the can 104 is rotated two turns at a rate of one turn per about 1.8 reciprocation of the traverse guide 105. FIG. 2B shows the pattern of the yarn piled at the bottom of the can 104 after the can has made about 20 turns. As is clear from FIGS. 2A or 2B, when the end points of the stroke of the reciprocal movement of the traverse guide 105 are caused to slightly move in the circumferential direction every time when the can 104 makes one half rotation, the yarn 102 is piled in the form of a doughnut without a core without being overlapped.

Referring back to FIG. 1, reference numeral 107 denotes a tank storing a cleaning liquid 109; 108, a shower; and 110, a cleaning liquid supply line interconnecting between the tank 107 and the shower 108. A pump 110' is inserted into the supply line 110. A hole is formed at the center of the bottom of the can 104 and is communicated with the interior of the can supporting pipe 106. The lower end portion of the can supporting pipe 106 is formed with openings which are communicated with the interior of the tank 107. Therefore the cleaning liquid circulation path is composed of the tank 107 the supply line 110 including the pump 110', the shower 108, the center hole at the bottom of the can 104, the opened upper end of the can supporting pipe 106, the interior of the pipe 106, the holes at the lower end portion of the can supporting pipe 16 and then the tank 10 again. While the yarn 102 is being piled at the bottom of the can 104 in the form of a ring, the cleaning liquid 109 is pumped up by the pump 110' to the shower 108 from which the cleaning liquid 109 is continuously sprayed against the yarn 102 so that the yarn 102 is thoroughly cleaned. The cleaning liquid 109 which has been sprayed against the yarn 102 is returned through the can supporting pipe 106 as indicated by the arrow to the tank 107 for recirculation.

After the yarn of, for instance, 100,000 meters has been piled in the manner described above on the bottom of the can 104, the can 104 is removed from the can supporting pipe 106 so that the yarn 102 is withdrawn out of the can 104. The yarn 102 is withdrawn out of the can 104 at a relatively high velocity. Accordingly, when the step to be described below is employed, the coil of the yarn in the upper layer is entangled with the coil of the yarn in the lower layer. Therefore, in order to overcome such problem, according to the present invention, beads 105 are filled into the can 104 to cover the yarn which is cleaned and piled on the bottom of the can 104 by the layer of beads 115. In this case, the trailing end of the yarn 102 is left over the top surface of the layer of beads 115.

The beads 115 are plastic pellets of polyethylene, polypropylene, tefron, polyacetal, nylon and the like or grains such as glass, small stones, soy beans, red beans, rice and the like and have preferably a specific gravity between 0.3 and 4. It is more preferable that the beads 115 have a specific gravity between 0.7 and 3.0. When metal balls having a high specific gravity, excessive tension is exerted to the yarn 102 so that the yarn 102 is damaged. On the other hand, when the beads 115 have a low specific gravity, a large quantity of beads 115 is needed so that it is not preferable to use the beads with a low specific gravity. When the diameters of the beads 115 are too large, tensions are non-uniformly exerted to the yarn 102, but when the diameters are too small such that the beads are in the form of power, they electrostatically adhere to the yarn 102. Therefore, the diameters of the beads 115 are preferably between 0.1–10 mm and more preferably between 1 and 5 mm. Preferably the beads 115 are in the form of a sphere, a cylinder or a rice grain and have smooth surfaces so that they flow like a fluid. In the case of the beads 115 consisting of plastic pellets, it is preferred that they contain an anti-electrostatic agent.

Figure 4:
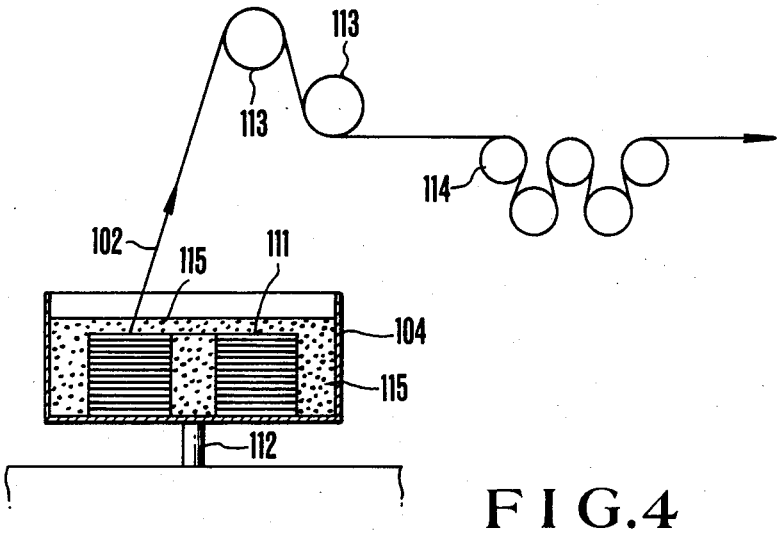
FIG. 4 is a view used to explain the withdrawal of the yarn after the yarn has been piled and cleaned.

FIG. 4 shows a method for withdrawing the yarn 102 from the can 104 filled with the beads 115. The can 104 which is removed from the piling and cleaning device as shown in FIG. 1 and is filled with the beads 115 is coupled to a rotary shaft 112. A pair of yarn withdrawal rollers 113 are disposed above the can 104 and a plurality of parallel rollers 114 are disposed in a zig-zag form at the downstream side of the yarn withdrawal roller 113. Upon rotation of the yarn withdrawal rollers 113, the yarn 102 is withdrawn out of the piled yarn 111 within the can 104 and a suitable tension is imparted to the withdrawn yarn 102 by means of the parallel rollers 114. Thereafter, the yarn 102 is sent to the drying step. In this case, the rotary shaft 112 is rotated by a motor or the like in the direction opposite to the direction in which the can 104 is rotated while the yarn 102 is piled and cleaned so that the yarn 102 is untwisted. More specifically, assume that the yarn 102 is piled at the rate of S meters per minute in the piling an cleaning device as shown in FIG. 1 and that the can 105 is rotated at N turns per minute. Then the piled yarn 111 is twisted at a rate of $T=N/S$ turns per meter. Therefore, in order to untwist the yarn 102 by the withdrawal device as shown in FIG. 4, the ratio $N_1/S_1$, where $N_1$ represents the number of rotations per minute and $S_1$ represents the withdrawal rate $S_1$ meters per minute, must be substantialy equal to the above described rate T.

Prior to the withdrawal of the yarn 102, the beads 115 are filled into the can 104 in such a way that the piled yarn 111 is almost embedded into the beads 115. As a result, the upper layer of beads 115 presses the upper surface of the piled yarn 111, whereby the piled yarn 111 maintains a predetermined tension. Since the yarn 102 is withdrawn from the beads 115, it is squeezed by the fluidized beads 115 so that it is untwisted and the interwined yarn is released. As a result, the lower piled yarn remains within the layer of the beads 115 and the yarn 102 is smoothly withdrawn. According to the experimental results, breakdowns occur every five to ten minutes by the prior art method, but according to the present invention no breakdown occurs even in the five-hour continuous operation.

Since beads 115 are filled in the annular space defined between the outer periphery of the piled yarn 111 and the inner wall surface of the can 104 and into the center hole of the piled yarn 111, when the yarn 102 is withdrawn and accordingly the height of the piled yarn 111 is decreased the beads 115 are caused to drop over the piled yarn 111, as a result, the thickness of the layer of the beads 115 over the piled yarn 111 is increased, thereby applying heavy load on the piled yarn 111. Such phenomenon is not preferable in practice. It is preferable to insert rings or rods into the annular space and the center hole to prevent excessive accumulation of the beads 115 in such spaces.

So far the withdrawal device as shown in FIG. 4 has been described as being disposed independently of the piling and cleaning device as shown in FIG. 1, but it is to be understood that after the yarn 102 is piled and cleaned in the can 104, the hollow shaft 106 and the rollers 103 or other withdrawal rollers can be rotated in the opposite direction at the predetermined rates as described above to withdraw the yarn 102.

Figure 5:
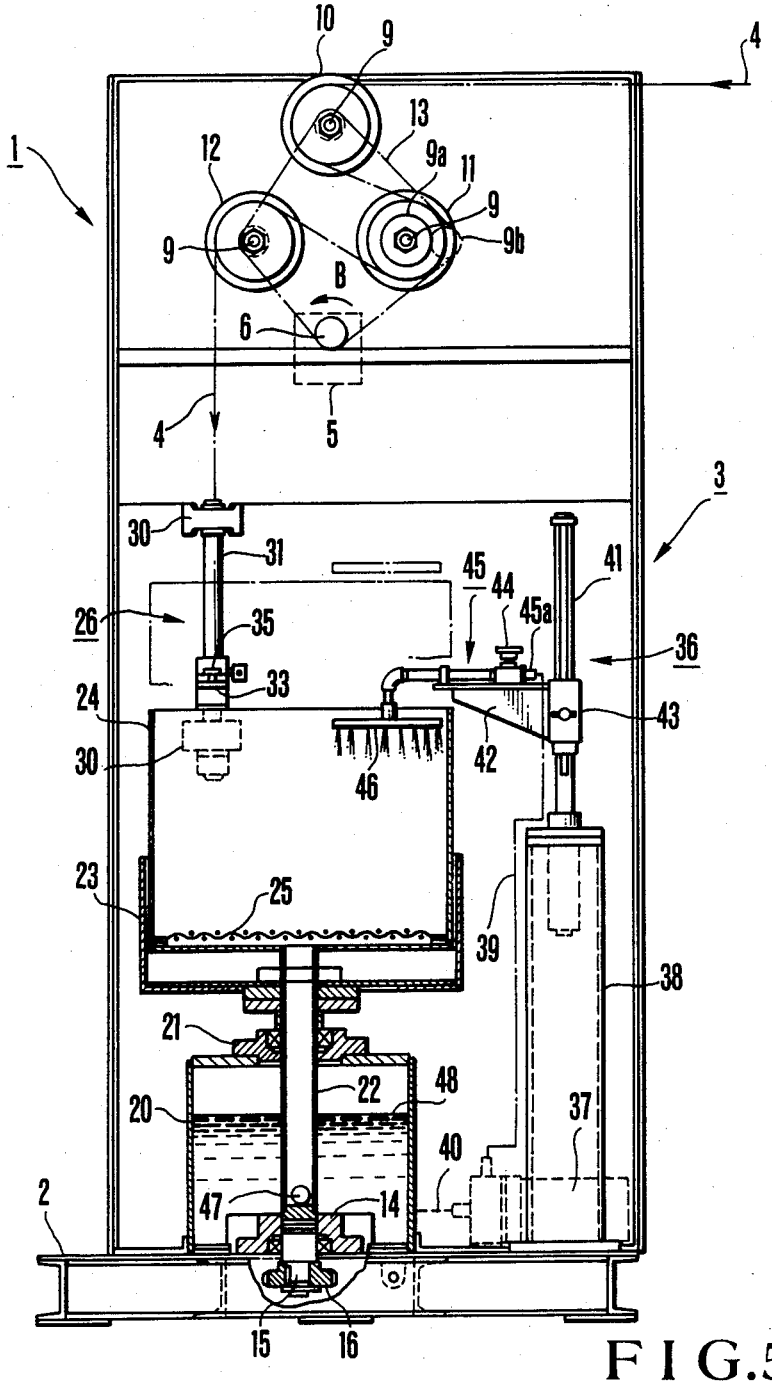
FIG. 5 is a longitudinal sectional view of a device for piling and cleaning yarn adapted to be used to carry out the method of the present invention.
Figure 6:
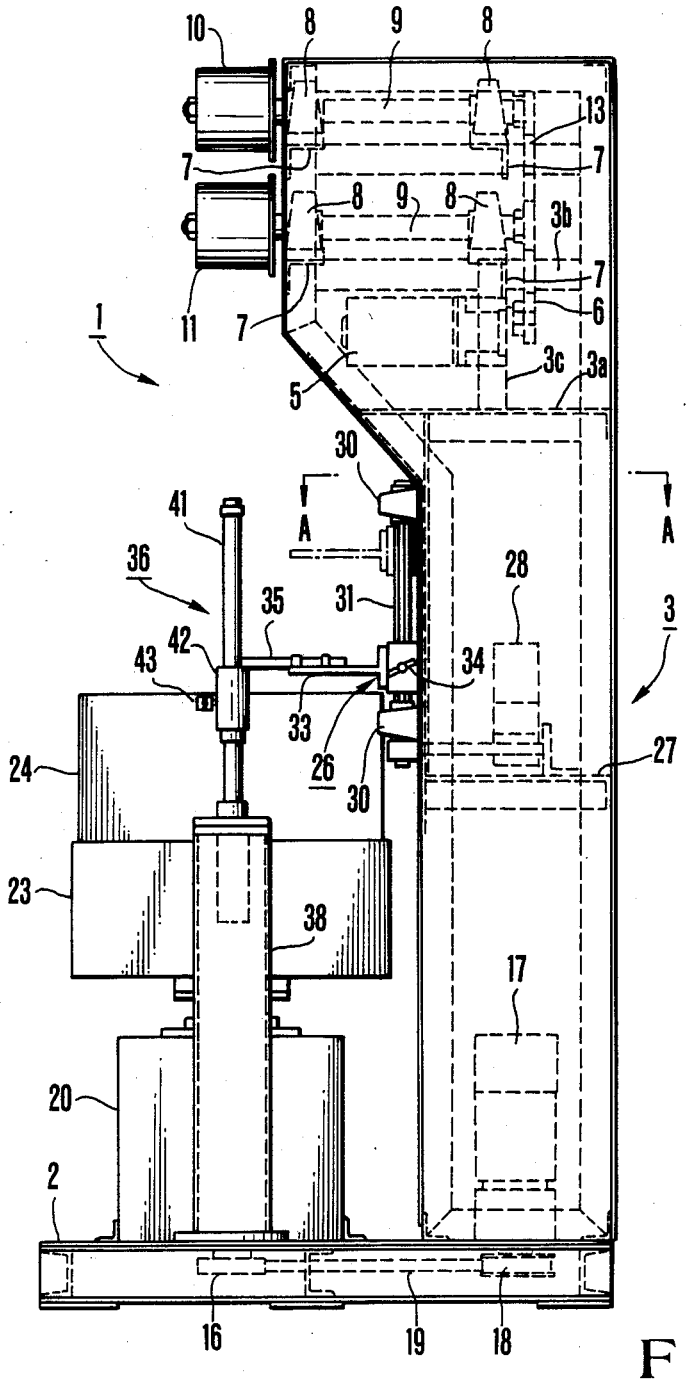
FIG. 6 is a side view thereof.
Figure 7:
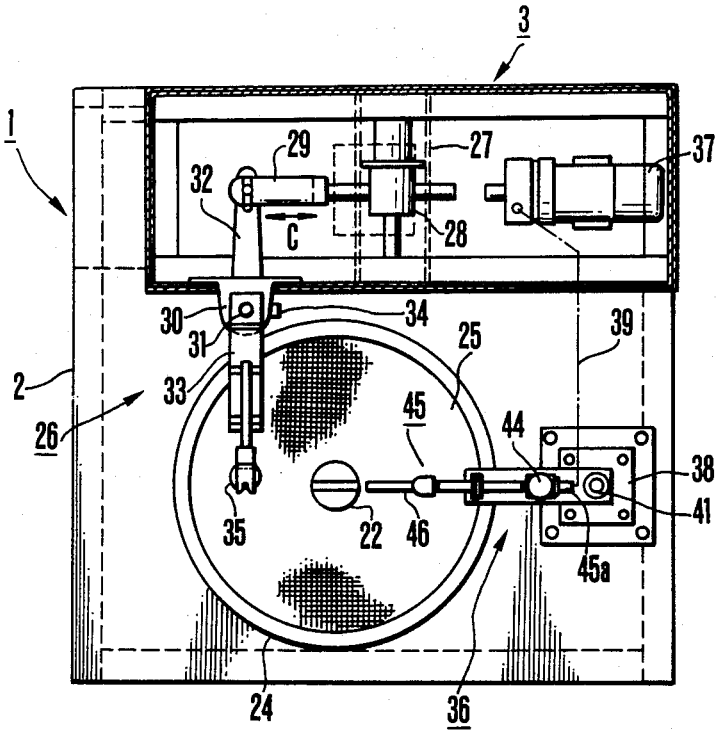
FIG. 7 is a sectional view taken along the line A—A of FIG. 6.

FIGS. 5, 6 and 7 shows a piling and cleaning device which is used to carry out the method for piling and cleaning the spun yarn in accordance with the present invention. FIG. 5 is a longitudinal sectional view thereof; FIG. 6 is a side view thereof and FIG. 7 is a sectional view taken along the line A—A of FIG. 6.

The piling and cleaning device generally indicated by the reference numeral 1 has a machine base 2 which is constructed with shape steels and securely mounted on the floor. An elongated box-shaped frame 3 is securely erected on side edges of the machine base 2 and a plurality (six polyamid yarns 100 microns in outer diameter in this embodiment) of yarns 4 which are injected through the spinning nozzles, separated from a liquid and solidified are horizontally extended toward the top of the frame 3. Reference numeral 5 designates a motor which is securely mounted on a motor mounting stand 3*c* in the form of a frame interconnecting between the partition wall 3*a* and the stay 3*b* in the upper portion of the frame 3 and which rotates at a lower speed so as to drive rollers. A motor pulley 6 is carried by the shaft of the motor 5 which rotates in the direction indicated by the arrow B in FIG. 5. Four transverse stays 7 are extended between the right and left frame side plates above the motor 5 and three pairs of bearings 8 (each pair consisting of front and rear bearings) are disposed in the form of a triangle (See FIG. 5) on the transverse stays 7. Withdrawal rollers 10, 11 and 12 each with a single-sided flange are carried by the shafts 9 which are extended out of the frame 3 and are supported by the bearings 8. The yarns 4 are threaded around the withdrawal rollers 10, 11 and 12 in the order named and directed downward. A belt 13 drivingly interconnects between the motor pulley 6 and the pulleys carried by the roller shafts 9 so that the withdrawal rollers 10, 11 and 12 are rotated. In order to cause the withdrawal rollers 10, 11 and 12 to rotate in the same direction, only the withdrawal roller 11 is driven through gears 9*a* and 9*b*. With this arrangement, the yarns 4 are caused to move downward from the withdrawal roller 12 at a slow rate of, for example, 5–30 meters per minute.

A sprocket 16 is carried by a short shaft 15 which in turn is supported by a bearing 14 mounted on the machine base 2 and is drivingly coupled through a chain 19 to a sprocket 18 of a can drive motor 17 mounted on the machine base 2 within the frame 3. A cleaning tank 20 is disposed on the machine base 2 in coaxial relationship with the short shaft 15 and will be described in more detail hereinafter. A bearing 21 which is mounted at the top of the cleaning tank 20 supports the upper end of a can supporting pipe 22 welded to the short shaft 15 coaxially thereof. The upper end of the can supporting pipe 22 extended upwardly of the bearing 21 is connected to a can receiver 23 which has a double bottom construction and is opened upward. The interior of the can receiver 23 is communicated with the interior of the can supporting pipe 22 at the center of the bottom of the can receiver 23. A can 24 is in the form of a cylinder with the top removed and can be detachable received into the can receiver 23. A net 25 which can permit the passage of a cleaning agent and is made of stainless steel wires, plastic wires, wires coated with a plastic or the like, is extended at the bottom of the can 24. The can 24 is so designed and constructed to rotate in unison with the can receiver 23 at a relatively low speed of, for instance, 10–15 turns per minute by the motor 17.

A traverse device 26 for traversing the yarns 4 which move downwards is interposed between the can 24 and the withdrawal roller 12. More specifically, a motor 28 is mounted on a stay 27 extended in the middle portion of the frame 3 and its motor shaft is connected to a crank mechanism or an eccentric mechanism (not shown) adapted to cause the reciprocal movement of a rod 29 in the directions indicated by the double-pointed arrow in FIG. 7. A lever shaft 31 is supported by an upper bearing 30 and a lower bearing 30 securely mounted on the frame 3 in such a way that the rotation of the lever shaft 31 is permitted but the axial displacement thereof is not permitted. The lower end of the lever shaft 31 is pivoted to a lever 32 which is inserted into an elongated slot of the rod 29 so as to swing in response to the reciprocal movement of the rod 29. A guide supporting lever 33 is vertically movably supported by the lever shaft 31 and has a butterfly screw 34. Therefore, after the guide lever 33 has been shifted to the position indicated by the solid line or by the broken lines in FIG. 6, it is securely held in the position by tightening the butterfly screw 34. A traverse guide 35 is mounted on the guide supporting lever 33 in such a way that the fine adjustment of the position of the traverse guide 35 can be effected. The traverse guide 35 is provided with a hollow guide in the path of the yarns 4. Therefore, when the yarns 4 are inserted into the hollow guide, they are directed into the can 24 and piled on the net 25 at the bottom thereof. In this case, the guide supporting lever 33 is caused to swing so that the yarns 4 to be piled are traversed.

The can assembly is provided with a wetting device for wetting the yarns 4 piled in the can 24 with a cleaning agent. In this embodiment, the wetting device is a circulation type shower device 36. More specifically, a pump 37 is mounted on the machine base 2 within the frame 3 and a column 38 having a rectangular cross sectional configuration is mounted on the machine base 2 outside of the frame 3. The pump 37 and an inlet port 45*a* of a shower 45 to be described in more detail hereinafter are intercommunicated with each other by means of a line 39 such as a vinyl hose. The pump 37 and the tank 20 are intercommunicated with each other through a line 40 as best shown in FIG. 5. A upright shower supporting pipe 41 is joined to the upper surface of the column 38 by means of a flange and has its lower end portion extended into the column 38. A bracket 42 is carried by the shower supporting pipe 41 in such a manner that the rotation of the bracket 42 is not permitted but the vertical movement of the bracket 42 is permitted. After the bracket 42 has been brought to a suitable position, it is securely held in position by tightening a butterfly screw 43. The bracket 42 supports the shower 45 which is communicated through the line 39 with the pump 37 and has a valve 44 and a plurality of nozzles 46 directed downward into the can 24. The lower end portion of the can supporting pipe 22 is formed with a plurality of holes 47 in communication with the interior of the tank 20 in which is stored a cleaning liquid 48 consisting of water and a cleaning agent. Upon energization of the pump 37, the cleaning liquid 48 is sucked by the pump 37 and is delivered through the line 40, the pump 37, the line 39 and the inlet 45*a* to the shower 45 so that the cleaning liquid 48 is sprayed through the nozzles 46 over the piled yarns 4. Thereafter, the cleaning liquid 48 passes through the net 25 and flows through the can supporting pipe 22 and the holes 47 into the tank 20. Thus the cleaning liquid 48 is circulated. The cleaning liquid 48 extracts the solvent contained in the yarns 4 to clean the yarns 4 and further serves to maintain the yarns 4 in the can 24 in the wet condition, thereby preventing an uneven dry condition. When the traverse device 26 and the shower device 36 are raised to the positions indicated by the broken lines, the can 24 can be inserted into or pulled out of the can receiver 23.

Next the mode of operation of the device for piling and cleaning spun yarn with the above-described construction will be described. The cleaning liquid 48 is stored in the tank 20 and the pump 37 and the motors 5 and 17 are energized to start the spinning operation. The yarns which are injected through the spinning nozzles into a solidification solution and separated from a liquid and solidified and elongated, are transported toward the piling and cleaning device 1 and threaded through the withdrawal rollers 10, 11 and 12 so that the yarns 4 can be withdrawn at a relatively low speed of, for instance, 50–30 meters per minute. The yarns 4 drop by their own weight so that their tension is less than 0.5 g. The yarns 4 are inserted through the traverse guide 35 and dropped into the can 24 which is rotating. Simultaneously the traverse guide 35 is reciprocating so that the yarns 4 are piled on the net 25 of the can 24 in the form of a doughnut. The cleaning liquid 48 is pumped up in the manner described above and is sprayed through the nozzles 46 of the shower 45 so that the solvent contained in the yarns 4 which are being piled is extracted and the yarns 4 are cleaned. Since the yarns are wetted, they are prevented from being nonuniformly dried and are uniformly wetted and deposited over the net 25 in the can 24. The cleaning liquid 48 which has wetted the yarns 4 passes through the net 25 and flows through the can supporting pipe 22 and its holes 47 into the tank 20 for recirculation.

As described above, the yarns 4 drops by their own weight and then are piled. As a result, their tension is as less as 0.5 g. Furthermore, they are not made into contact with any part except the traverse guide 35. As a result, they are prevented from breaking off or being damaged.

Figure 8:
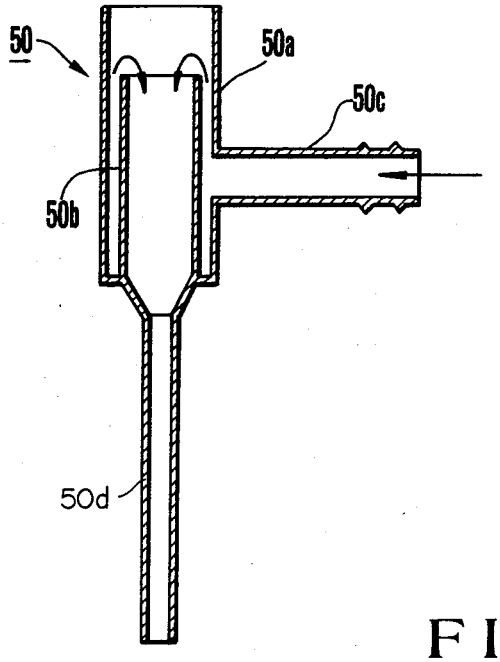
FIG. 8 is a sectional view showing another embodiment of a traverse guide used in the present invention.

FIG. 8 shows in section another example of a traverse guide 50. As in the case of the traverse guide 35 described above, the traverse guide 50 is supported by the guide supporting lever 33 as shown in FIG. 7 and comprises an outer pipe 50*a* and an inner pipe 50*b* extended downwardly of the outer pipe 50*a*. An inlet 50*c* of the outer pipe 50*a* is connected to a line such as a vinyl hose. The yarns 4 are made to pass through the inner pipe 50*b* and drop into the can 24. The cleaning liquid 48 is supplied to the inlet 50*c*. Therefore, the cleaning liquid 48 fills the space defined between the outer and inner pipes 50*a* and 50*b* and overflows into the inner tube 50*b* as indicated by the arrows to wet and stretch or elongate the yarns 4, thus flowing downward in unison with the yarns 4. An inner diameter of the downwardly extended portion 50*d* is slightly larger than that of the yarns 4. Therefore, the yarns 4 are sufficiently wetted and a liquid film is formed between the yarns 4 and the inner wall surface of the small-diameter nozzle portion 50*d* of the inner pipe 50*b*, so that the friction is decreased and consequently the yarns 4 can smoothly drop. As a result, the yarns 4 are piled in the can 24 in a more preferred form. The spacing between the yarns 4 and the inner wall surface of the reduced-diameter nozzle portion of the inner pipe 50*b* is depedent upon the diameters of the yarns 4 and it suffices if the spacing is from 0.2 to a few millimeters. When the spinning operation is continued for a long period of time, the cleaning liquid 48 which is circulated through the shower 45 and the traverse guide 50 is contaminated. In this case, the cleaning liquid 48 is supplied from an exterior cleaning liquid supply source to the shower 45 and the traverse guide 50 while the cleaning liquid 48 in the tank 20 is recovered into an external reservoir or the like.

With the above-described piling and cleaning device 1, a predetermined length of yarn is piled and cleaned and then the beads 115 are filled in the can 24. Thereafter the can 24 and the rollers 10, 11 and 12 are reversed in rotation so that the piling and cleaning device 1 can be used as the withdrawing device as shown in FIG. 5.

As described above, according to the method for piling and cleaning spun yarn in accordance with the present invention, an extremely long yarn can be piled and cleaned within the can so that a required space can be reduced to a minimum. The yarn is piled in the can be its own weight so that no excessive tension is exerted to the yarn.

When the piled and cleaned yarn is withdrawn out of the can filled with the beads, there is no fear that the yarn is entangled and the yarn can be smoothly withdrawn at a high speed.

As a result, the space required for the step for piling and cleaning the spun yarn can be reduced to a minimum and the piling and cleaning operation can be accomplished within a short period of time. Thus, the yarn product which is long in length without any seam and is free from any abrasion or damage can be obtained.

What is claimed is:

1. A method for piling and cleaning spun yarn comprising the steps of withdrawing a spun yarn at a predetermined velocity, dropping said yarn by its own weight into a cylindrical container with a bottom having holes while traversing said yarn in the radial direction of said cylindrical container so that said yarn is piled at the bottom of said cylindrical container in the form of a ring, continuously sparying a cleaning liquid against said yarn while said yarn is being piled, filling beads into said cylindrical container in such a way that said beads cover the piled yarn in said cylindrical container while extending the trailing end of said yarn out of the top surface of said bead, and rotating said container in the direction opposite to the direction in which said cylindrical container was rotated while said yarn was being piled and cleaned, whereby said piled and cleaned yarn is withdrawn out of said cylindrical container from said trailing end of said yarn to the exterior of said cylindrical container.

2. A method according to claim 1 wherein said cleaning liquid sprayed in said yarn is circulated.

3. A method according to claim 1 wherein said yarn is dropped through a tube whose inner diameter is slightly larger than said yarn, and said cleaning liquid continuously flows into said tube from a top thereof.

* * * * *